United States Patent [19]

Saijo

[11] Patent Number: 4,932,302

[45] Date of Patent: Jun. 12, 1990

[54] TREMOLO DEVICE FOR A GUITAR

[75] Inventor: Yatsuse Saijo, Kobe, Japan

[73] Assignee: Kabushiki Kaisha P-Project, Japan

[21] Appl. No.: 431,843

[22] Filed: Nov. 6, 1989

[30] Foreign Application Priority Data

Nov. 8, 1988 [JP] Japan ..... 63-280383
Dec. 8, 1988 [JP] Japan ..... 63-308875

[51] Int. Cl.[5] ..... G10D 3/12
[52] U.S. Cl. ..... 84/313
[58] Field of Search ..... 84/313

[56] References Cited

U.S. PATENT DOCUMENTS

| | | | |
|---|---|---|---|
| 668,604 | 2/1901 | Russell | 84/320 |
| 2,741,146 | 4/1956 | Fender | 84/313 |
| 3,185,011 | 5/1965 | Anderson | 84/293 |
| 4,171,661 | 10/1979 | Rose | 84/313 |
| 4,497,236 | 2/1985 | Rose | 84/298 |
| 4,638,711 | 1/1987 | Stroh | 84/313 |

FOREIGN PATENT DOCUMENTS

| | | | |
|---|---|---|---|
| 3130187 | 11/1982 | Fed. Rep. of Germany | 84/313 |
| 683531 | 2/1965 | Italy | 84/313 |

*Primary Examiner*—Lawrence R. Franklin
*Attorney, Agent, or Firm*—Finnegan, Henderson, Farabow, Garrett & Dunner

[57] ABSTRACT

A tremolo device for a guitar comprising a flat plate pivotably mounted about a fulcrum on the guitar, a bar secured to the flat plate, at least one tension spring for imparting rotational force to the flat plate and the bar in one rotating direction, against another rotating force derived from a tension of guitar strings, and a tremolo arm manually engageable with the flat plate to oscillate the flat plate and the bar to thereby produce a tremolo effect. The fulcrum is provided by at least two contacts between a pin-shaped member having a substantially half-spherical tip portion on a front end thereof and a concave member having a depression into which the pin-shaped member is inserted.

13 Claims, 3 Drawing Sheets

TREMOLO DEVICE FOR A GUITAR

BACKGROUND OF THE INVENTION

1. Field of the Invention

The present invention relates to a tremolo device for a guitar, and more particularly, it relates to a device enabling a smoother handling thereof when the tremolo device is used.

2. Description of the Related Art

A guitar, for example, an electric guitar, equipped with a tremolo device which is manually moved to produce a tremolo effect on musical tones obtained by, for example, plucking the strings, is well-known and widely used. Known conventional tremolo devices include a synchronized device fitted to guitars made by the Fender Company (U.S. Pat. No. 2,741,146), a "Bigsby" device fitted to guitars made by the Gibson Company, and a "Vibramute" device fitted to guitars made by the Mosrite Company, and these tremolo devices have basically similar constructions.

Namely, these devices are provided with springs having a tension almost the same as the total tension of the strings of the guitar, and while an equilibrium is maintained between the tension of the springs and the total tension of the strings, the tones of the strings of the guitar are raised or lowered by moving a rod member, i.e., a tremolo arm, upward and downward in relation to a guitar body, to thus rotate the tremolo device about one fulcrum on the guitar body and thereby vary the tension of the guitar strings.

In one of the conventional tremolo devices mentioned above the fulcrum about which the tremolo device is rotated is provided by two contacts between a flat plate, which receives and anchors strings of the guitar, and two screws screwed into a guitar body. In this device, the flat plate has a knife-edge shaped front end which comes into contact with V-shaped grooves formed on the screws, to lower frictional resistance occurring when activating the tremolo device and to enable a smoother handling thereof.

In such a tremolo device, however, a problem arise in that the knife-edge shaped front end of flat plate is linear engaged with the V-shaped grooves of screws, i.e., a smooth handling of the tremolo device can be realized only when a bottom of a groove of one screw is aligned with a bottom of a groove of the other screw; namely, a height of one V-shaped groove from a top surface of the guitar body must be equal to a height of the other V-shaped groove. Accordingly if the height of one V-shaped groove is not the same as the height of the other V-shaped groove after, for example, the heights of the strings of the guitar are adjusted, or after a thorough overhaul of the guitar, the frictional resistance occurring when using the tremolo device will be remarkably increased to thereby make the handling of the tremolo device uneven and difficult.

SUMMARY OF THE INVENTION

An object of the present invention is to solve the above-mentioned problem by providing a tremolo device for a guitar by which it is possible to realize a smooth handling of the device even if the height of one contact is not the same as the height of the other contact.

The above object is achieved, according to the present invention, by providing a tremolo device for a guitar comprising: a base plate means able to receive and anchor strings of the guitar and including a flat plate pivotably mounted about a fulcrum on the guitar, and a bar secured to the flat plate, the bar extending from the flat plate into a guitar body; spring means including at least one tension spring, the tension spring having one end engaged with the guitar body and another end engaged with the bar, to thereby urge the base plate means in a direction of rotation opposite to a rotating force applied to the base plate means in an another direction of rotation due to a tension of the guitar strings; and a tremolo arm extending from and manually engageable with the base plate means to oscillate the base plate means and thereby vary a tension applied to the strings, whereby a tremolo effect is produced; the fulcrum being provided by at least two contacts between a pin-shaped member provided with a substantially half-spherical tip portion having a predetermined curvature, and a concave member able to come into contact with the pin-shaped member and having a depression in the form of a circular opening having a radius greater than that of the predetermined curvature of the half-spherical tip portion.

DESCRIPTION OF THE PREFERRED EMBODIMENTS

Figure 1:
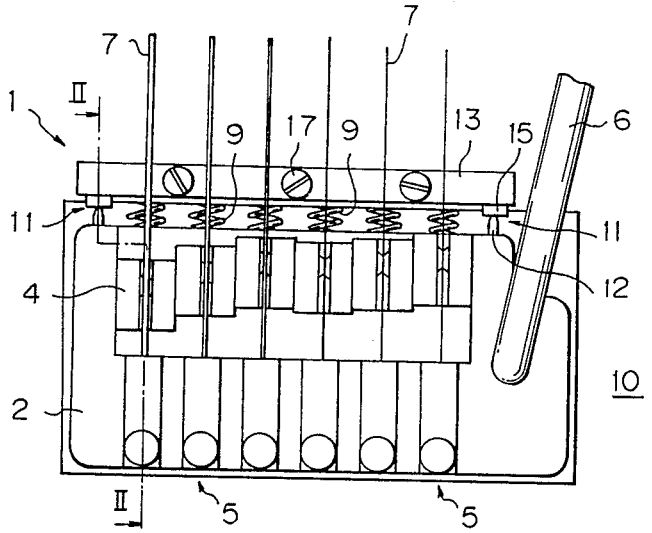
FIG. 1 is a plan view of a tremolo device, according to a first embodiment of the present invention.
Figure 2:
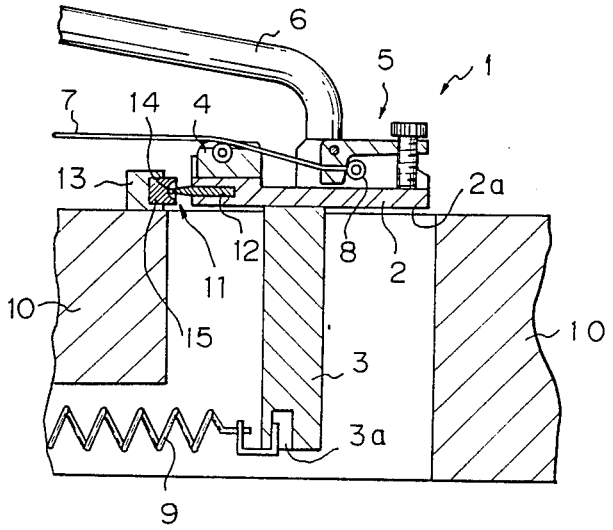
FIG. 2 is a partial sectional view taken along the line II—II of FIG. 1.

Referring to FIGS. 1 and 2, reference numeral 1 designates a tremolo device for a guitar in accordance with the first embodiment of the present invention. As shown in FIG. 1, the tremolo device 1 includes a flat plate 2 and a bar 3 secured to a lower surface 2*a* of the plate 2. The flat plate 2 has a plurality of bridge members 4 and corresponding anchor members 5 arranged thereon.

Reference numeral 6 designates a tremolo arm. The tremolo arm 6 is screwed into the flat plate 2 and extends upward therefrom, and referential numeral 7 designates strings of the guitar, the extremity of each string 7 being provided with an anchor element 8 seated on the anchor member 5. Each string 7 is then passed over the corresponding bridge member 4, and the other extremity of each string 7 is fixed to a tuning peg in a guitar head, not shown in the figures.

The bar 3 is provided with recesses 3*a* at the lower extremity thereof, and one end of each of a plurality of tension springs 9 is engaged with a respective recess 3*a*. The other ends of the tension springs 9 are connected to a guitar body 10. Note, the plurality of tension springs 9 may be replaced by one tension spring. The tension springs 9 impart a rotational force to the bar 3 and the flat plate 2 in a clockwise direction as seen in FIG. 2, against an another rotating force in the opposite direction, i.e., the counter-clockwise direction as seen in FIG. 2, derived from the total tension of the strings 7.

Reference numeral 11 designates a fulcrum about which the flat plate 2 is rotated. The tremolo arm 6 is manually engageable to oscillate the flat plate 2 and the bar 3 about this fulcrum 11, to thereby vary the tension of the guitar strings 7, and thus produce a tremolo effect while raising or lowering the tone of the guitar strings 7.

To provide the fulcrum 11 of the tremolo device 1, two pin-shaped members 12 are inserted in a front end of the flat plate 2 on one hand, and a receiving member 13 is arranged on the guitar body 10. As shown in detail in FIG. 3, each pin-shaped member 12 has a ball 14 embedded in a tip of the member 12, to form a half-spherical tip portion having a predetermined curvature. The ball 14 is made of rigid material such a steel. The receiving member 13 has two concave members 15 embedded in each side thereof, corresponding to two pin-shaped members 12, and each concave member 15 is provided with a half-spherical depression 16 into which the corresponding pin-shaped member 12 can be easily inserted. Namely, the concave member 15 is formed in such a manner that a circular opening of the depression 16 has a greater radius than the above predetermined curvature of the ball 14. Preferably, the concave member 15 is hardened by, for example, quenching process, to prevent abrasion of the concave member 15 by the pin-shaped member 12. Note that the receiving member 13 is fixed to the guitar body 10 by screws 17.

According to the above-described construction of the fulcrum of the tremolo device, it is possible to realize a smooth handling when activating the tremolo device, since a point of each pin-shaped member 12 comes into contact with each concave member 15, whereby frictional resistance occurring at the fulcrum 11 will be remarkably reduced in comparison with the conventional linear contact. Furthermore, even if the receiving member 13 is mounted and inclined to a top surface of the guitar body 10, a smooth handling of the tremolo device 1 still can be realized, for the above reasons.

Figure 4:
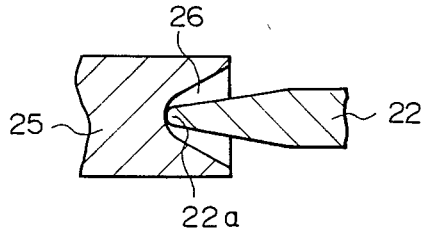
FIG. 4 is a view showing a modification of the contact of FIG. 3, according to a second embodiment of the present invention.

FIG. 4 shows a second embodiment of the present invention.

Figure 3:
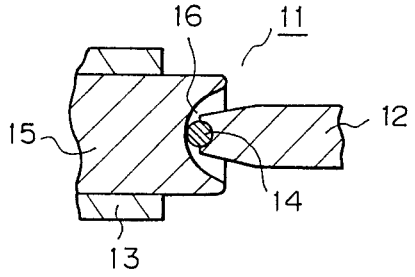
FIG. 3 is a partial enlarged sectional view of FIG. 2, showing a contact between a pin-shaped member and a concave member.

According to this embodiment, there are provided a pin-shaped member 22 and a concave member 25, corresponding to the above pin-shaped member 12 and the concave member 15, respectively. Namely, in this embodiment, the pin-shaped member 22 is not provided with the rigid ball 14 as shown in FIG. 3, but the member 22 itself is formed with a half-spherical tip portion 22*a* having a predetermined curvature. Also, the concave member 25 is provided with a substantially conical-shaped depression 26 having a circular opening which has a greater radius than the curvature of tip portion 22*a*.

Figure 5:
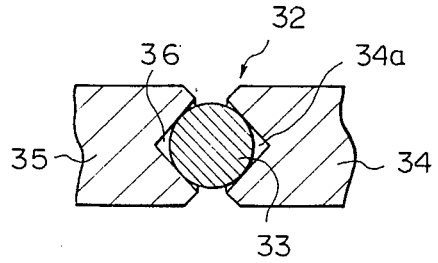
FIG. 5 is a view showing another modification of the contact between the pin-shaped member and the concave member, according to a third embodiment of the present invention.

FIG. 5 shows a third embodiment of the present invention, which provides a fulcrum different from those provided by the first and second embodiments.

According to this embodiment, a pin-shaped member 32 comprises a rigid ball 33 and a ball-receiving pin 34 provided with a conical-shaped depression 34*a* into which the ball 33 is mounted, and a concave member 35 provided with a conical-shaped depression 36 into which the ball 33 is mounted. That is, the ball-receiving pin 34 is linked to the concave member 35 through the intermediary of the ball 33. Note that a circular opening of the conical-shaped depression 36 has a greater diameter than that of the ball 33. Namely, the former has a greater radius than a curvature of tip of the pin shaped member 32. Although the pin-shaped member 32 comes into contact with the concave member 35 in a circular line in this embodiment, it is possible to realize a smooth handling when activating the tremolo device, due to the rotation of the ball 33.

Although the pin-shaped member 12, 22 or 32 is attached to the flat plate 2 and the concave member 15, 25 or 35 is mounted on the stable guitar body 10 in the above embodiments, it will be understood by those skilled in the art that the pin-shaped member may be arranged on the guitar body and the concave member may be attached to the flat plate as a modification.

Figure 6:
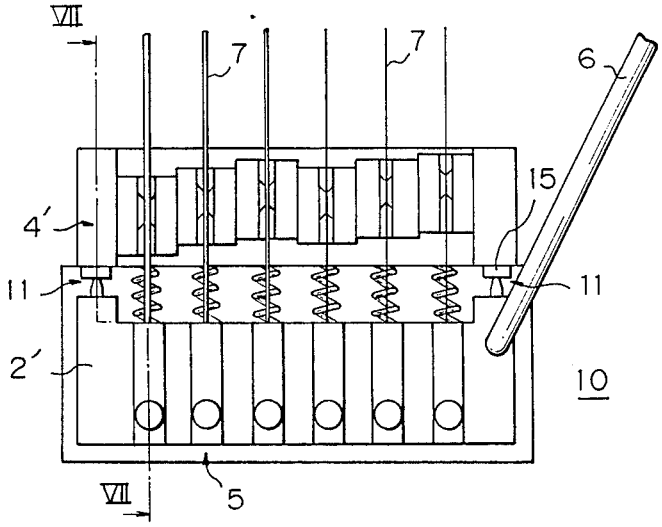
FIG. 6 is a plan view similar to FIG. 1, showing a tremolo device which comprises a bridge member arranged on a guitar body and a concave member embedded in the bridge member, according to a fourth embodiment of the present invention; and, FIG. 7 is a partial sectional view taken along the line VII—VII of FIG. 6.
Figure 7:
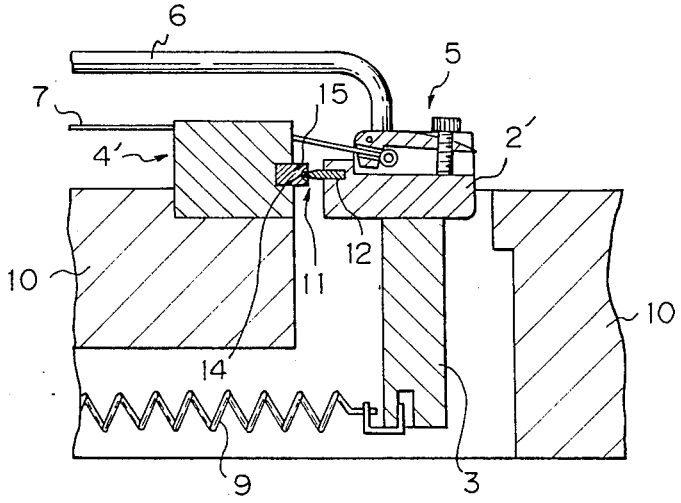

FIGS. 6 and 7 show a fourth embodiment of the present invention.

Note, in FIGS. 6 and 7, elements similar to those of the first embodiment shown in FIGS. 1 and 2 are indicated by the same reference numerals, and elements corresponding to those of the first embodiment are indicated by the same reference numerals suffixed with a prime.

According to this embodiment, a bridge member 4' is separated from a flat plate 2' i.e., the member 4' is mounted on the guitar body 10. In addition, the member 4' has two concave members 15 embedded in each side thereof. Therefore, in this embodiment, the receiving member 13 of the first embodiment can be omitted, to thereby reduce the number of components of the tremolo device. Furthermore, according to this embodiment, by mounting the bridge member 4' supporting the strings 7 on the guitar body 10, the levels of the strings 7 from the guitar body 10 will be constant even if the tremolo device is activated. Consequently, unexpected contact of the strings 7 with frets of a fingerboard (not shown), which often occurs with the conventional tremolo device when moving the tremolo arm upward, will be eliminated. Furthermore, even when playing the guitar while resting the hand on the bridge member 4', without a tremolo effect, the tuning of the guitar will not be affected, due to the stable mounting of the member 4'.

It will be understood by those skilled in the art that the foregoing description is of preferred embodiments of the disclosed tremolo device, and that various changes and modifications may be made to the present invention without departing from the spirit thereof. For example, although the fulcrum in the previous embodiments is positioned on the guitar body, it may be located in a guitar hole into which the bar of the tremolo device extends to thereby enable a change of the feeling of handling of the tremolo arm as required by the player.

I claim:

1. A tremolo device for a guitar comprising:

(1) base plate means able to receive and anchor strings of said guitar and including a flat plate pivotably mounted about a fulcrum on said guitar, and a bar secured to said flat plate, said bar extending from said flat plate into a body of said guitar;

(2) spring means including at least one tension spring, said tension spring having one end engaged with said guitar body and another end engaged with said bar, to thereby urge said base plate means in a direction of rotation opposite to a rotating force applied to said base plate means in another direction of rotation due to a tension of said guitar strings; and (3) a tremolo arm extending from and manually engageable with said base plate means to oscillate said base plate means and thereby vary a tension applied to said strings, whereby a tremolo effect is produced;

said fulcrum being provided by at least two contacts between a pin-shaped member provided with a substantially half-spherical tip portion having a predetermined curvature, and a concave member able to come into contact with said pin shaped member and provided with a circular depression having an opening has a radius larger than said predetermined curvature of said half-spherical tip portion.

2. A tremolo device according to claim 1, wherein said pin-shaped member is arranged in a front end of said flat plate and said concave member is arranged on said guitar body.

3. A tremolo device according to claim 1, wherein said pin-shaped member is arranged on said guitar body and said concave member is arranged in a front end of said flat plate.

4. A tremolo device according to claim 2 or 3, wherein a rigid ball is embedded in a front end of said pin-shaped member and said rigid ball provides said half-spherical tip.

5. A tremolo device according to claim 4, wherein said rigid ball is made of steel.

6. A tremolo device according to claim 5, wherein a hardening treatment is applied to said concave member.

7. A tremolo device according to claim 6, wherein said hardening treatment is a quenching process.

8. A tremolo device according to claim 7, wherein said depression of said concave member is half-spherical.

9. A tremolo device according to claim 2 or 3, wherein said pin-shaped member is formed to have a half-spherical tip portion having said predetermined curvature, and said depression of said concave member is formed to be substantially conical.

10. A tremolo device according to claim 9, wherein a hardening treatment is applied to said concave member.

11. A tremolo device according to claim 2 or 3, wherein said pin-shaped member comprises a rigid ball and a ball-receiving pin provided with a conical-shaped depression into which said rigid ball is mounted, and wherein said depression of said concave member is formed to the conical, whereby said ball-receiving pin is linked to said concave member through the intermediary of said rigid ball.

12. A tremolo device according to claim 2, further comprising a bridge member over which said strings are passed, wherein said bridge member is mounted on said guitar body and said bridge member has said concave member embedded therein.

13. A tremolo device according to claim 12, wherein a rigid ball is embedded in a front end of said pin-shaped member and said depression of said concave member is formed to be half-spherical.

* * * * *